US005575695A

United States Patent [19]

De Bernardis

[11] Patent Number: 5,575,695

[45] Date of Patent: Nov. 19, 1996

[54] ELECTRICAL CONNECTORS

[75] Inventor: Bernardo De Bernardis, Lancashire, United Kingdom

[73] Assignee: Dynedeem Limited, United Kingdom

[21] Appl. No.: 384,588

[22] Filed: Jan. 30, 1995

Related U.S. Application Data

[63] Continuation of Ser. No. 962,195, filed as PCT/GB91/01010 Jun. 21, 1991 published as WO91/20110 Dec. 26, 1991, abandoned.

[30] Foreign Application Priority Data

Jun. 21, 1990 [GB] United Kingdom ..... 9013869

[51] Int. Cl.[6] ..... H01R 4/48

[52] U.S. Cl. ..... 439/838; 439/441; 439/834

[58] Field of Search ..... 439/438–441, 439/372, 341, 867, 861, 862, 835, 836, 864, 456, 464, 465, 834, 838

[56] References Cited

U.S. PATENT DOCUMENTS

| | | | |
|---|---|---|---|
| 3,671,924 | 6/1972 | Nagano | 439/440 |
| 4,303,293 | 12/1981 | Grunwald . | |
| 4,634,211 | 1/1987 | Poliak et al. | 439/456 |
| 4,759,726 | 7/1988 | Naylor et al. | 439/441 |
| 4,945,192 | 7/1990 | Urushibata et al. | 439/867 |

FOREIGN PATENT DOCUMENTS

| | | |
|---|---|---|
| 2488452 | 8/1981 | France . |
| 1008684 | 3/1983 | United Kingdom . |

*Primary Examiner*—David L. Pirlot
*Attorney, Agent, or Firm*—Laubscher & Laubscher

[57] ABSTRACT

An electrical connector (10) has a first resilient member (14) which is pivotally connected to a second member (18). The first member (14) is pivotally movable between a first position in which a wire can be held within the connector (10) by flexure of a part (20) of the first member (14) and a second position in which the first member (14) is spaced from the second member (18) and a wire can be inserted or removed from the connector. A latch (26) is provided to retain the first member (14) in the first position. A method of attaching a wire to the electrical connector is also disclosed.

7 Claims, 1 Drawing Sheet

ELECTRICAL CONNECTORS

This is a continuation of application Ser. No. 07/962,195, filed as PCT/GB91/01010 Jun. 21, 1991 published as WO91/20110 Dec. 26, 1991 now abandoned.

BACKGROUND OF THE INVENTION

The present invention relates to an electrical connector and to a method of attaching a wire to electrical connector.

BRIEF DESCRIPTION OF THE INVENTION

In UK Patent Nos. 1 161 017 and 1 076 687 there are shown a connector including a resilient strip of material which is arranged to be flexed during inserting of a wire. However, the wire must be resistant to binding during insertion. Indeed No. 1 076.687 specifically refers to the wire being tinned or clipped in solder in order to stiffen it. Should the wire bend during insertion then a satisfactory connection would not be achieved. In order to remove a wire from the connector shown in No. 1 076 687 it is necessary to insert a release tool through a narrow part of a hole of the connector to move a leg of the connector out of engagement with the wire. UK Patent No. 1 449 025 shows a connector in which a contact blade biased into engagement with a wire, but which blade can be held against that bias by causing a pivoting movement with a screwdriver in order to insert or remove a wire. However, one hand of the user is required to operate the screwdriver and the other is required to hold the connector thus making it difficult to thread the wire into the connector.

SUMMARY OF THE INVENTION

According to one aspect of the present invention an electrical connector includes a first member and a second member, the first and second members being connected and being movable relative to each other between a first position, in which a portion off the first member is adjacent to and is resiliently biased towards an abutment surface of the second member whereby a wire located between the first member and the surface of the second member experiences a compressive force, and a second position in which the first member is spaced from the surface of the second member and is not resiliently biased towards that surface.

The resilient bias of the first member may be provided by at least a portion a the first member being flexed.

The first member may comprise a resilient flexible strip.

According to another aspect of the present invention an electrical connector includes a first member comprising a flexible member and a second member, the first and. second members being movable relative to each other between a first position, in which the first member is retained by a latch means whereby a wire may be urged against a surface of the second member by the flexure of the first member, and a second position in which the latch means are released and in which a wire may be inserted or removed from the connector.

The first member may be spaced from the second member in the second position.

The first and second members may be directly connected or, alternatively or additionally, pivotally connected. The first member may be detachably connected, for instance by a snap-fit. The first member may be loosely connected.

The connector may include latch means arranged to retain the first member in the first position. Part of the latch means may be provided on the first member or, alternatively or additionally, part of the latch means may be provided on the second member. As the first member moves towards the first position the first member may be arranged to flex by moving over an abutment surface and the first member may be arranged to be retained in the first position as a result of that flexure. The first member may be arranged to flex when being moved away from the first position, and that flexure of the first member may be arranged to occur during initial movement of the first member away from the first position.

The first member may be pivotally movable relative to the second member. The shape of the first member from the location about which it is pivotally movable to the location of the latch means may allow the first member to flex in that direction. The first member may be arranged to co-operate with the surface of a latch means which extends away from the pivotal axis of the first member.

The connector may provide a tortuous path for a wire connected to the connector extending away from the connector. The general extent of the surface of the second member against which the first member holds a wire when in a first position may be at a different elevation than a second surface of the second member against which a wire is arranged to be located.

Movement of the first member to the first position may be arranged to bend a wire.

The first member may comprise an integrally formed member. The first member may be formed from a flat strip.

The first member may be allowed to remain in the second position under gravity.

The first and the second member may both comprise electrically conductive material.

In the second position wire may be capable of being brought towards, or removed from the surface of the second member against which, in the first position, it is biased against by the first member in a direction transverse to the extent or the surface of the second member.

In the first position the first member may extend away from a wire held in the connector in a direction opposed from that which the wire extends away from the connector.

According to another aspect of the present invention, a method of attaching a wire to an electrical connector comprises placing a wire in the region of an abutment surface of a second member with a first member being in a second position in which it is spaced from that surface and is not resiliently biased towards that surface and causing relative movement of the first and second members such that the first member is moved to a first position in which a portion of the first member is resiliently biased towards the surface of the second member to exert a compressive force on the wire against the abutment surface.

The method may comprise providing the resilient bias of the first member in the first position by causing at least a portion of the first member to be flexed.

According to another aspect of the present invention, a method of attaching a wire to an electrical connector comprises locating the wire in the region of an abutment surface of a second member and utilising latch means to retain a first member in a first position in such a manner that the wire is urged against the surface of the second member by flexure of the first member.

The method may comprise causing relative movement of the first and second members to move the first member to the first position by causing relative pivotal movement between the members. The method may comprise causing flexure of the first member relative to the axis of its pivotal movement when moving the first member to or from the first position.

The method may comprise causing the wire to extend along a tortuous path out of the connector.

The movement of the first member to the first position may be arranged to bend a wire.

The method may comprise the first member remaining in the second position under gravity.

The present invention includes any combination of the herein referred to features or limitations.

The present invention may be carried into practice in various ways, but one embodiment will now be described by way of example and with reference to the accompanying drawings, in which:

BRIEF DESCRIPTON OF THE FIGURES

FIG. 1 is a schematic perspective view of an electrical connector with a wire connected thereto, and FIG. 2 is a schematic side view of the connector with a spring member in an open position in which the connector is receptive to the insertion or removal of a wire therefrom.

DETAILED DESCRIPTION

Figure 1:
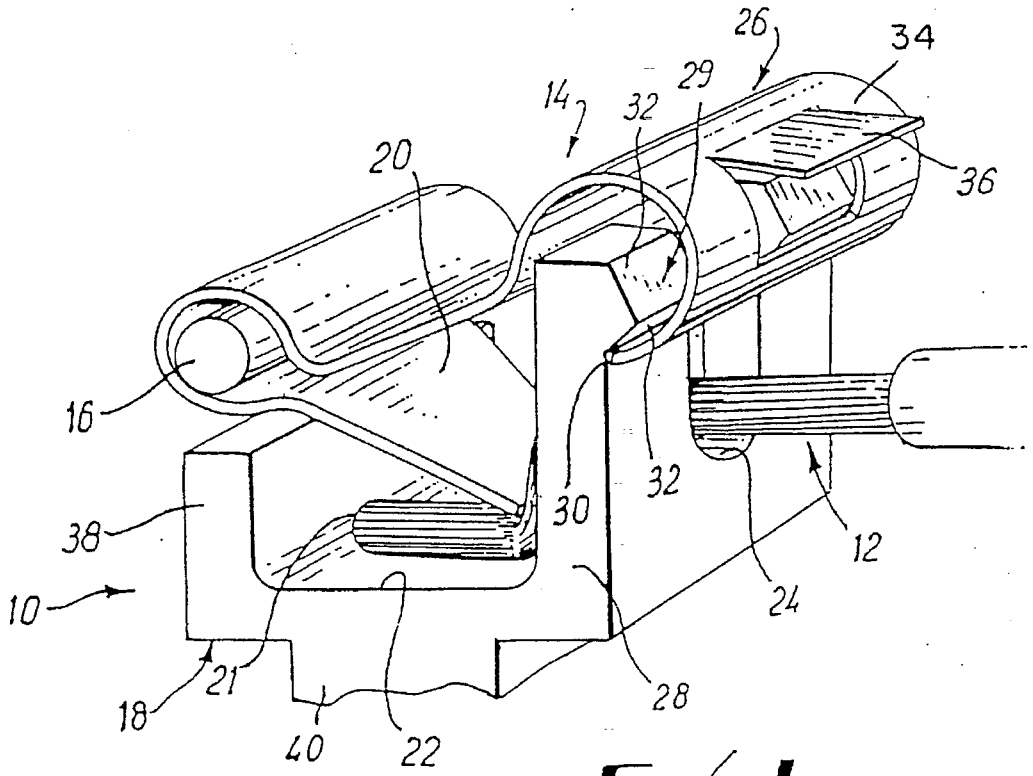

As shown in FIG. 1, the spring member 14 of the electrical connector 10 is pivotally mounted about a bar 16 of a base member 18. A plate 20 of the spring member 14 extends downwardly and forwardly (when viewed in FIG. 1), and the plate is biased in a clockwise direction about the bar 16 such that its forward lower edge is held against and grips the wire 12.

The wire 12 extends, from its free end 21, over a flat surface 22 of the base member, and then upwardly before passing out of a U-shaped opening 24 of the base member in a direction generally parallel to its extent over the flat surface 22. The base of the opening 24 is at a greater elevation than the flat surface 22 of the base member whereby the wire is constrained to follow a tortuous path to prevent inadvertent removal of the wire from the connector such as may otherwise occur if the wire is parallel. The wire may be very flexible in its longitudinal direction.

The plate 20 is retained in the position shown by a clip portion 26 of the spring member extending forwardly from the bar 16 and over the forward wall 28 of the base member where the clip bends back on itself and passes under a pair of spaced latch projections 29 extending forwardly from the front surface of the wall 28 on either side of the U-shaped opening 24.

Figure 2:
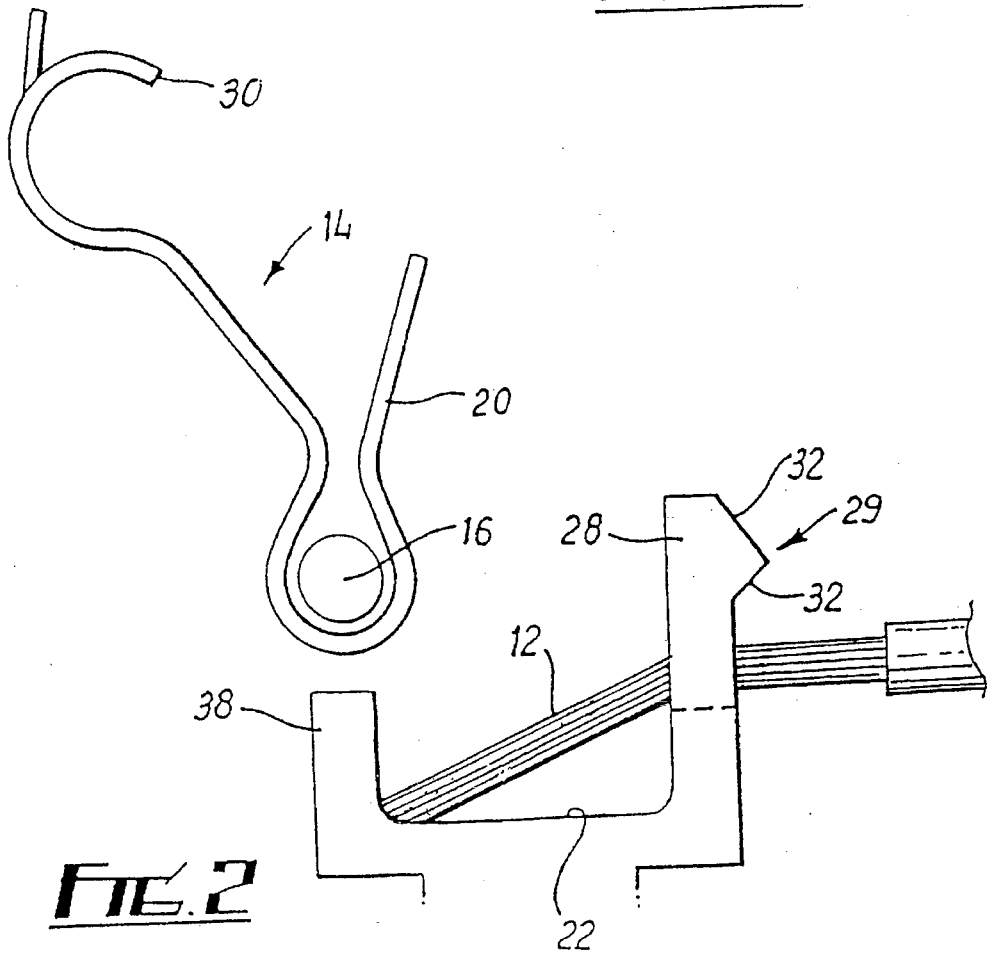

In order to attach a wire to the connector, the spring member 14 is first located in the position shown in FIG. 2 in which the plate 20 extends upwardly and a wire can be inserted such that its free end is in the region of a rear wall of the base member and the wire projects out of the opening 24. The clip portion 26 is then pivoted in a clockwise direction to bring the plate 20 downwardly into contact with the wire, with continued downwards movement of that plate causing the wire to bend into the tortuous configuration shown in FIG. 1. The clip portion 26 is then urged further downwardly without the plate 20 moving to the same degree thereby causing the spring member to flex and bias the plate 20 against the wire. As the clip portion 26 is moved further downwardly, the then downwardly facing front edge 30 of the clip portion engages the downwardly and outwardly facing surfaces 32 of the latch projections 29. During that movement, the clip portion is caused to flex such that the distance from bar 16 to the front edge 30 increases. This flexural movement is able to be achieved because of the curl 34 at the free end of the clip portion and because of the curved path between the curl 34 and the bar of the clip portion.

When the front edge 30 of the clip portion passes over the end of the downwardly and outwardly facing surface 32 the flexure in the clip portion biases the front edge 30 against the downwardly and rearwardly facing surfaces 32 of the latch portion to urge that front edge towards and down those surfaces 32 and to more firmly bias the plate 20 against the wire.

In order to release a wire held in the connector, an outwardly extending handle 36 is pushed upwardly to cause the front edge 30 of the clip portion to slide up the surfaces 32, with the clip portion flexing outwardly, until those surfaces are cleared whereupon the clip portion may be moved upwardly and rearwardly to the position shown in FIG. 2 in order that the wire may be removed or another wire inserted.

It can be seen from FIG. 1 that the front edge 30 of the clip portion 26 is always well clear of the wire extending through the U-shaped opening, and that thus the latching operation of the clip portion will not be interfered with by the wire. It can also be seen that the front edge of the plate 20 is just clear of the rearwardly facing surface of the wall 28 at its nearest point thereto during closure. The degree of flexure in the device and the clearances referred to above make the spring member easy to produce without fine manufacturing tolerances having to be adhered to.

The bar 16 of the base member 18 is connected at either end to the upwardly extending rear wall 38 of the base member, although those connections are not shown in the drawings for clarity. Accordingly a slot exists between the bar and the rear wall through which the plate 20 of the spring member is inserted during assembly of the two parts. The width of the plate 20 is reduced to facilitate in its insertion into that opening. The spring member is also shaped such that, under its natural flexure, the shortest distance between the plate 20 and the clip portion is less than the thickness of the bar whereby the spring member is snapped into, and must be snapped off the bar.

The spring member is formed from a single sheet of metal which is cut and shaped as shown with the handle 36 being stamped to project out of the sheet.

It will be appreciated that the spring nature of the plate enable wires of different thicknesses to be held in the connector.

If desired, the material of the spring member or the shape of the spring member can be varied to alter the resilience of the plate, the force exerted on a wire in the connector, and the force required to secure or release the latch.

The connector may be used in a plug connector with leg 40 of the base member extending to provide a pin the plug.

I claim:

1. An electrical connector comprising (a) a base member (18) including an abutment surface (22); and (b) a unitary spring clip member (14) rotatably mounted on said base member, said spring clip member including a contact arm portion (20) and a catch arm portion (26) which are resiliently deformable towards one another, said contact arm portion being rotatable into engagement with said base member abutment surface, said catch arm portion engaging said base member to releasably connect said spring clip and base members together in a deflected position where said contact arm portion and said catch arm portion deflect together, whereby said contact arm portion is resiliently biased against said base member abutment surface to clamp a wire therebetween when said clip member is in the deflected position.

2. An electrical connector as defined in claim 1, wherein said spring clip member comprises a resilient flexible strip.

3. An electrical connector as defined in claim 2, and further comprising latch means to retain said spring clip member in said deflected position.

4. An electrical connector as defined in claim 3, wherein said latch means comprises a projection on said base member above said abutment surface and a curled free edge on said spring clip member catch arm portion which curls over said projection.

5. An electrical connector as defined in claim 4, wherein said base member includes a wall portion (28) arranged normal to said abutment surface, said projection being arranged on said wall portion, said wall portion containing an opening (24) between said projection and said abutment surface, whereby a wire clamped by said connector follows a tortuous path through said opening to said abutment surface.

6. An electrical connector as defined in claim 5, wherein said spring clip is rotatably mounted on said base member via a snap-fit connection.

7. An electrical connector as defined in claim 6, wherein said base and clip members are formed of electrically conductive material.

* * * * *